US012376651B2

(12) United States Patent
Ahmed

(10) Patent No.: US 12,376,651 B2
(45) Date of Patent: Aug. 5, 2025

(54) REMOVABLE TOE BOX PROTECTOR FOR SNEAKERS

(71) Applicant: Crep Protect Limited, London (GB)

(72) Inventor: Rizwan Ahmed, London (GB)

(73) Assignee: CREP PROTECT LIMITED, London (GB)

( * ) Notice: Subject to any disclaimer, the term of this patent is extended or adjusted under 35 U.S.C. 154(b) by 0 days.

(21) Appl. No.: 18/756,048

(22) Filed: Jun. 27, 2024

(65) Prior Publication Data

US 2025/0017321 A1 Jan. 16, 2025

(30) Foreign Application Priority Data

Jul. 10, 2023 (GB) ..... 2310562

(51) Int. Cl.
*A43B 23/08* (2006.01)

(52) U.S. Cl.
CPC ..... *A43B 23/086* (2013.01)

(58) Field of Classification Search
CPC ... A43B 23/081; A43B 23/082; A43B 23/085; A43B 23/086; A43B 23/087
See application file for complete search history.

(56) References Cited

U.S. PATENT DOCUMENTS 4,257,177 A * 3/1981 Unsted ..... A43B 7/32 12/146 D
6,412,195 B1 7/2002 Mack et al.
11,266,205 B2 * 3/2022 Benchoff ..... A43B 23/081
D974,711 S * 1/2023 Xu ..... D2/909
D1,023,541 S * 4/2024 Liang ..... D2/909
2008/0148607 A1 * 6/2008 Spar ..... A43B 23/081 36/77 R

FOREIGN PATENT DOCUMENTS

CN 209473731 U 10/2019
DE 2935959 A1 4/1981
GB 2623398 A 4/2024
KR 20090110506 A 10/2009
(Continued)

OTHER PUBLICATIONS

English Translation of CN209473731 (Year: 2019).*
(Continued)

*Primary Examiner* — Ted Kavanaugh
(74) *Attorney, Agent, or Firm* — POLSINELLI PC

(57) ABSTRACT

A toe box protector, for removable insertion into a toe box of a sneaker to prevent the upper surface of the toe box from creasing, including a central portion defining a front part of the toe box protector and, adjacent thereto, first and second opposite wing portions which extend rearwardly of the central portion. The central portion and the first and second opposite wing portions define upper and lower edges of the toe box protector having a sandwich structure of outer and inner layers of flexible cellular foam, and an intermediate core layer of a reinforcement layer of solid polymeric material. The intermediate core layer has a lower edge spaced inwardly from the lower edge of the toe box protector, the lower edge having a two layer structure of a peripheral flexible unreinforced lower band in which the outer layer is bonded directly to the inner layer.

20 Claims, 5 Drawing Sheets

(56) References Cited

FOREIGN PATENT DOCUMENTS

| | | | |
|---|---|---|---|
| WO | 2009017730 | A1 | 2/2009 |
| WO | 2022/156570 | A1 | 7/2022 |

OTHER PUBLICATIONS

English Translation of WO2022156570 (Year: 2022).*
Extended European Search Report in related EP Application No. 24187771.1 issued on Oct. 25, 2024.
Combined Search and Examination Report under Sections 17 and 18(3) in related GB Application No. GB2310562.0 issued on Jan. 11, 2024.

* cited by examiner

REMOVABLE TOE BOX PROTECTOR FOR SNEAKERS

FIELD OF THE INVENTION

The present invention relates to a removable toe box protector for sneakers which can be removably inserted into a toe box of a sneaker to prevent the upper surface of the toe box from creasing.

BACKGROUND TO THE INVENTION

In recent years, sneakers (otherwise known as trainers, athletic shoes, gym shoes, etc.) have become popular for use as casual footwear. Many sneakers are marketed and purchased as high-cost fashion accessories produced by high-quality fashion and sportswear manufacturers. There is a thriving market in rare and second-hand sneakers. Sneaker collectors, known as "sneakerheads", aim to keep their sneakers in prime condition to maintain both the cosmetic appeal and the commercial value of the sneakers.

Since sneakers originate from sportswear and are primarily designed for flexibility and comfort, the toe box and vamp of the sneakers are flexible. The toe box of a sneaker (or other footwear) is the section of the sneaker that surrounds and covers the toes. The vamp of the sneaker (or other footwear) covers the instep and extends rearwardly from the toe box, for example towards the tightening mechanism, such laces, straps, etc. The upper surface of the rear part of the toe box, which covers the front part of the instep of the foot, and/or the upper surface of the vamp, often exhibit permanent creasing even after only minimal wearing of the sneakers. Such creasing is often considered to be cosmetically and stylistically undesirable, and can reduce the commercial value of the sneakers.

It is known to produce removable toe box protectors for sneakers which can be removably inserted into a toe box of a sneaker to prevent the upper surface of the toe box and/or vamp from creasing.

For example, U.S. Pat. No. 11,266,205B2 discloses a wearable shoe shaper which is a complex contoured sheet which is configured to fit over a person's foot in a front portion of a shoe. The shoe shaper includes a toe box portion, which covers the front part of the instep of the foot, an inner wing which covers the inner side edge of the foot and an outer wing which covers the outer side edge of the foot. The wearable shoe shaper is provided as a pair of wearable shoe shapers, one of which is shaped and configured for the user's right foot, and the other of which is shaped and configured for the user's left foot. The outer wing is provided with a cut-out, called a fifth toe vacancy, which positioned over the fifth toe when worn, to provide for the expansion of the foot during use. The upper edge of the toe box portion, which upper edge in use rests against the instep at a position typically about mid-way between the toes and the ankle, is provided with a raised portion, called an inner relief, which conforms to an elevated height of the navicular bone of the human foot, and a cut-out, called a mid-foot vacancy, which is arranged to avoid contact with the foot proximate to the intermediate cuneiform bone during walking. The wearable shoe shaper is composed of an injection moulded plastic (i.e. a polymeric material) which is sufficiently strong to prevent or inhibit the roof and sidewalls or front area of the shoe from creasing or wrinkling when a step is taken. The wearable the shoe shaper may be made of a plastic sheet that is thick enough to inhibit creasing, but thin enough to be cut with household scissors, to enable the wearable shoe shaper to be cut to shape by the user to fit a wide variety of shoes. Even though the wearable shoe shaper may prevent or reduce creasing, and is provided with additional cut-outs and a raised portion in order more accurately to correspond to the contours of the human foot, and can be cut to shape, nevertheless the user may suffer from discomfort when the wearable shoe shaper is inserted into the footwear, for example a pair of sneakers.

WO2009/017730A1 discloses a wearable shoe tree to be inserted within the interior of a shoe, thereby helping maintain the original shape of the shoe and preventing the front area (or toc box area) and side walls from creasing. and wrinkling over time. The wearable shoe tree comprises an insert having a toe box region, which provides a convex ceiling that snugly fits to the inner surface of the shoe upper and follows the contours from the shoe upper down to the floor of the shoe where the upper meets the sole, and two legs which extend from the toc box region to snugly, via pressure tension, snap into the inner surface of the shoe sidewalls. The insert is typically composed of a flexible plastic (i.e. a polymeric material) which may be cut to shape by the user; alternatively, the insert may be made from a non-plastic material such as wood, rubber, metal or ceramic. Again, the user may suffer from discomfort when the wearable shoe shaper is inserted into the footwear, for example a pair of sneakers.

WO2022/15670A1 discloses a double-layer shoe shield comprising a hard shoe shield body and a soft plastic inner layer. CN209473731U discloses a shoe shield in which the inside fitting of a protective cover is provided with a silica gel protection layer and the inside front ends of the protective cover are provided with a sponge enhanced protection layer in the form of two crescent shaped blocks. KR10-2009-0110506A discloses a safety shoe with an integral metal toe cap surrounding the top, sides and bottom of the wearer's toes.

Currently available commercial products comprise removable toe box protectors which are composed of injection moulded polymeric material. In one commercial product currently sold by the Applicant under the trademark Crep Protect Guards™, the removable toe box protector comprises an outer layer composed of injection moulded polymeric material, in particular polypropylene, and an inner layer composed of a flexible thermoplastic gel which, in use, provides increased user comfort as compared to a monolayer of injection moulded polymeric material.

Nevertheless, these known removable toe box protectors suffer from the problem that although creasing can be reduced or prevented, the toe box protectors can be uncomfortable for the user.

SUMMARY OF THE INVENTION

The present invention aims to provide a removable toe box protector for sneakers which can be removably inserted into a toe box of a sneaker to prevent the upper surface of the toe box from creasing, and which exhibits high comfort for the user in combination with high protection against creasing of the sneaker during use.

The present invention also aims to provide a removable toe box protector for sneakers which can be removably inserted into a toe box of a sneaker to prevent the upper surface of the toe box from creasing, and which exhibits increased comfort for the user, as compared to known removable toe box protectors, without a reduction in protection against creasing of the sneaker during use.

The present invention provides a removable toe box protector for sneakers which can be removably inserted into a toe box of a sneaker to prevent the upper surface of the toe box from creasing which can meet these aims.

The present invention accordingly provides a removable toe box protector for sneakers which can be removably inserted into a toe box of a sneaker to prevent the upper surface of the toe box from creasing, the toe box protector comprising a central portion defining a front part of the toe box protector and, adjacent thereto, first and second opposite wing portions which extend rearwardly of the central portion from respective opposite sides of the central portion and define a rear part of the toe box protector, wherein the central portion and the first and second opposite wing portions define an upper edge of the toe box protector, which upper edge is shaped and configured to be disposed adjacent to the instep, and along opposite sides of the instep, of a user's foot, and a lower edge of the toe box protector, which lower edge is shaped and configured to be disposed around at least a portion of the toes, the inside edge of the user's foot, and the outside edge of the user's foot, wherein the central portion and the first and second opposite wing portions comprise a sandwich structure comprising an outer layer comprising flexible cellular foam, an inner layer comprising flexible cellular foam and an intermediate core layer comprising a reinforcement layer of solid polymeric material, wherein the intermediate core layer has a lower edge which is spaced inwardly from the lower edge of the toe box protector, whereby the lower edge of the toe box protector comprises a two layer structure in the form of a peripheral flexible unreinforced lower band in which the outer layer is bonded directly to the inner layer.

Preferably, the toe box protector further comprises a cut-away part which is located on one side of the toe box protector and extends across a region of the central portion and a region of first wing portion, the first wing portion being shaped and configured to be disposed adjacent to an outer side of a user's foot, wherein in the cut-away part a portion of the lower edge is in the form of a curved arc which is raised relative to the lower edge at opposite ends of the cut-away part which are respectively positioned in the central portion and the first wing portion, whereby in use within the sneaker, the fifth toe of a user's foot extends through an opening in the toe box protector formed by the cut-away part.

In the preferred embodiment of the present invention, in the peripheral flexible unreinforced lower band the outer layer is bonded to the inner layer by a bonding area which extends across a lateral width of the peripheral flexible unreinforced lower band.

Preferably, the peripheral flexible unreinforced lower band is configured to be manually cuttable to be reduced in lateral width by manually cutting peripherally along the bonding area, and the bonding area is configured to continue to bond together the outer layer to the inner layer and form a sealed lower edge after removal of part of the bonding area by manual cutting.

Preferably, the peripheral flexible unreinforced lower band is provided with a plurality of mutually spaced, peripherally extending, marked cutting lines which are spaced inwardly from, and substantially aligned with, the lower edge of the toe box protector. In a preferred embodiment, the cutting lines are embossed into the lower band.

The cutting lines are typically formed on an inner surface of the toe box protector.

In the preferred embodiment of the present invention, the intermediate core layer has an upper edge which is spaced inwardly from the upper edge of the toe box protector, whereby the upper edge of the toe box protector comprises a two layer structure, in the form of a peripheral flexible unreinforced upper band in which the outer layer is bonded directly to the inner layer.

Preferably, the upper edge of the toe box protector forms a smoothly curved U-shape which is shaped and configured to fit adjacent to the instep, and along opposite sides of the instep, of the user's foot.

In the preferred embodiment of the present invention, in the central portion the intermediate core layer has an upper rearward part and a lower forward part, wherein the upper rearward part is substantially flat and substantially parallel to the lower edge, and the lower forward part is arcuate and extends downwardly from a curved front end of the upper rearward part, wherein the upper rearward part has a greater thickness, and a higher rigidity, than the lower forward part.

Preferably, the lower forward part extends downwardly from a curved front end of the upper rearward part at an angle of from 30 to 60 degrees to the upper rearward part.

Preferably, the upper rearward part is shaped and configured to be disposed above the toes, and the lower forward part is shaped and configured to be disposed in front of the toes of the user's foot.

In the preferred embodiment of the present invention, the intermediate core layer has first and second wing parts which respectively extend into the first and second opposite wing portions.

Preferably, in the first and second wing parts the intermediate core layer has a smaller thickness, and a lower rigidity, than the upper rearward part of the intermediate core layer in the central portion.

In the preferred embodiment of the present invention, in the outer layer the flexible cellular foam comprises a first ply of memory foam and in the inner layer the flexible cellular foam comprises a second ply of memory foam.

Preferably, the first ply of memory foam and the second ply of memory foam each have a thickness of from 1.5 to 4 mm, more preferably from 2 to 3 mm, typically about 2 mm.

In the preferred embodiment of the present invention, the outer layer further comprises an outermost fabric ply covering the flexible cellular foam in the outer layer and the inner layer further comprises an innermost fabric ply covering the flexible cellular foam in the inner layer.

Preferably, the outermost fabric ply and the innermost fabric ply are composed of a synthetic wicking fabric, and optionally the synthetic wicking fabric is composed of polyester fibres.

In the preferred embodiment of the present invention, the intermediate core layer is composed of a thermoplastic elastomer, and optionally the thermoplastic elastomer comprises polyurethane.

In the preferred embodiment of the present invention, in the sandwich structure the outer and inner layers are directly bonded together around the entire peripheral edge of the toe box protector.

Preferably, in the sandwich structure the outer and inner layers are directly bonded together around the entire peripheral edge of the toe box protector by a pressure welded seam.

Preferably, the toe box protector further comprises a plurality of ventilation holes extending through the central portion.

The present invention further provides a pair of the toe box protectors according to the present invention, wherein one of the toe box protectors is configured for fitting to a right foot of a user and the other of the toe box protectors is configured for fitting to a left foot of a user.

BRIEF DESCRIPTION OF THE DRAWINGS

Embodiments of the present invention will now be described by way of example only, with reference to the accompanying drawings, in which.

DETAILED DESCRIPTION OF THE PREFERRED EMBODIMENTS

Figure 1:
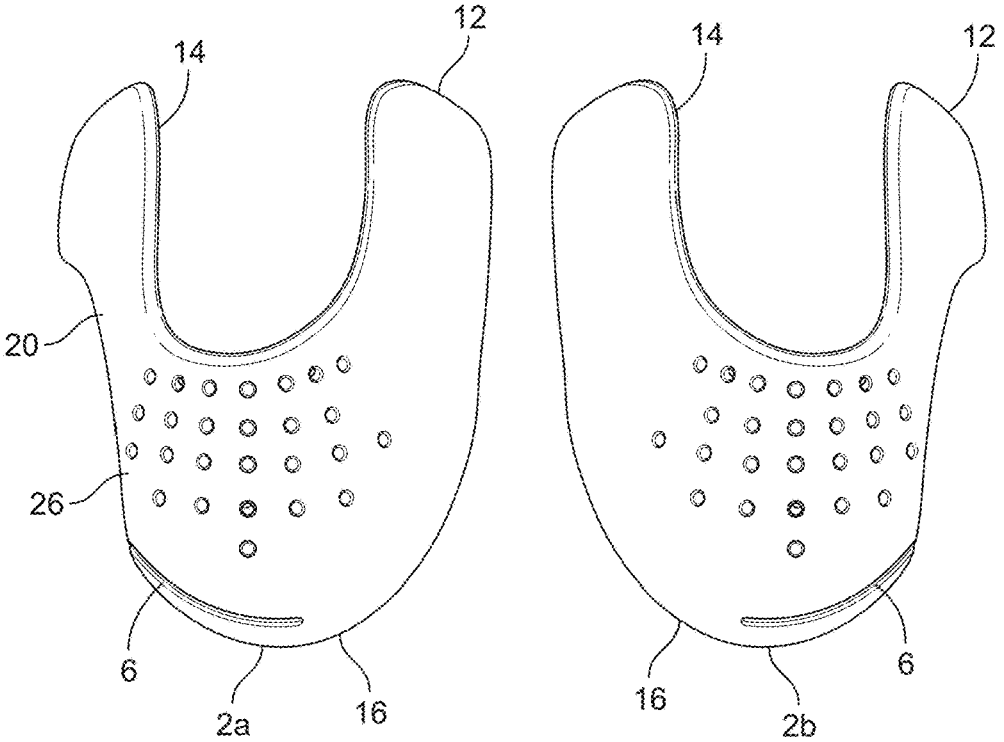
FIG. 1 is a plan view from above of a pair of removable toe box protectors for sneakers in accordance with an embodiment of the present invention.
Figure 2:
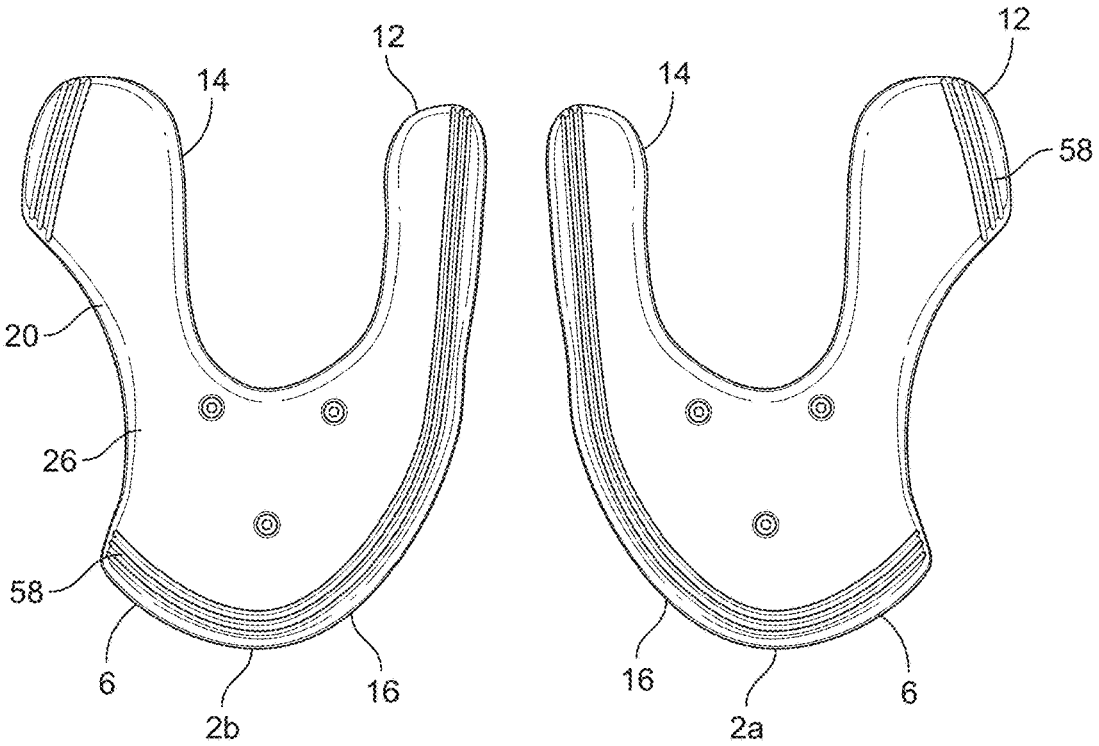
FIG. 2 is a plan view from below of the pair of toe box protectors shown in FIG. 1.
Figure 3:
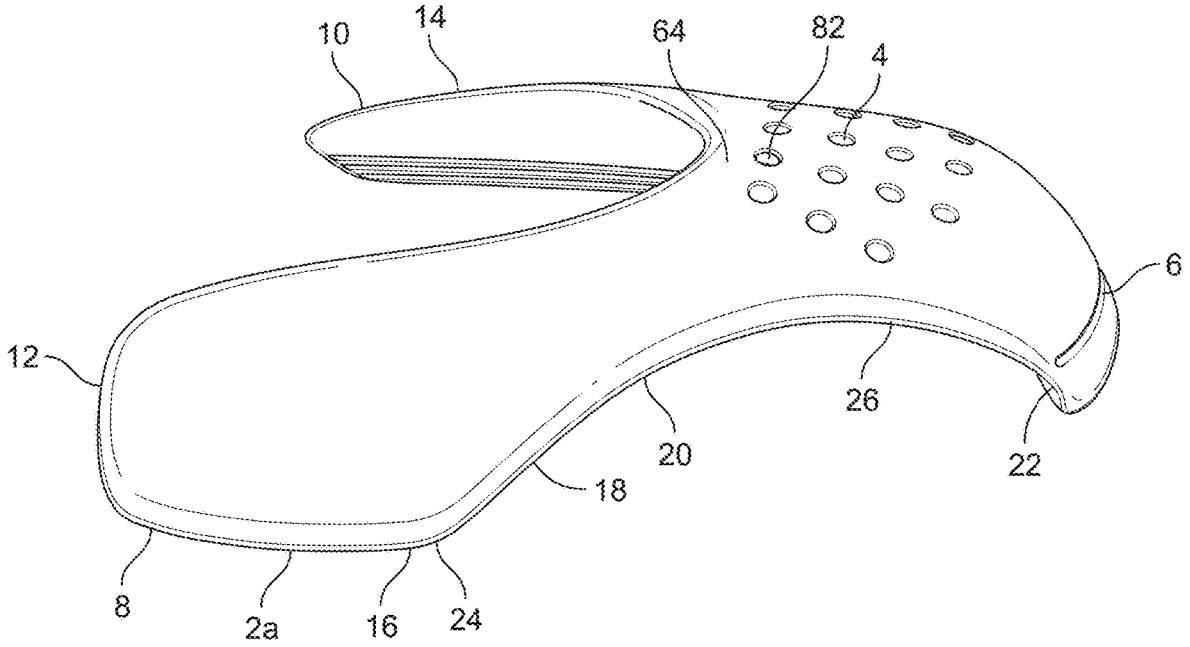
FIG. 3 is a perspective side view of one side of one of the toe box protectors shown in FIG. 1.
Figure 4:
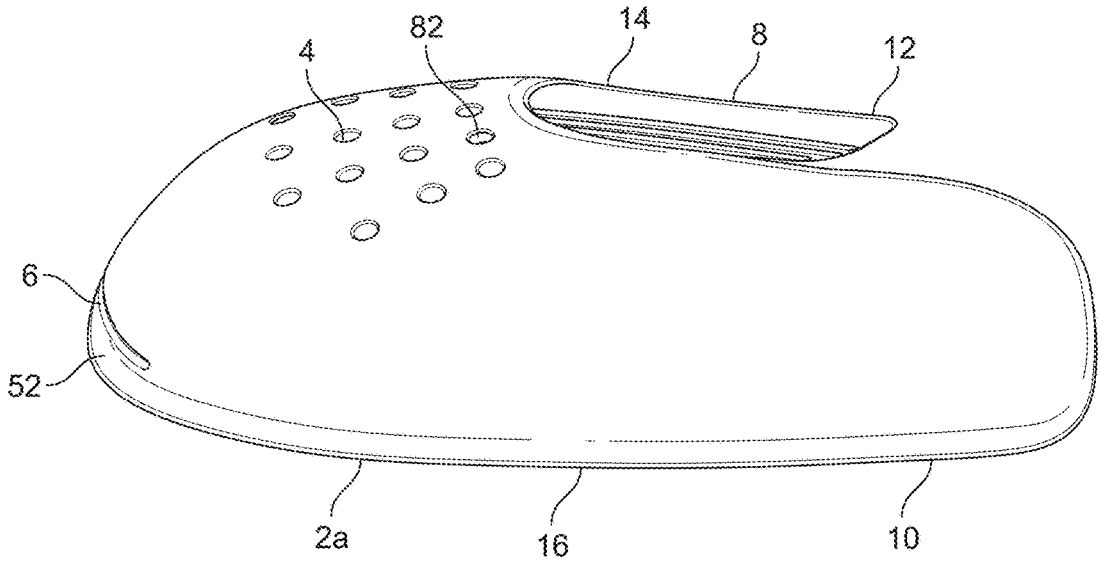
FIG. 4 is a perspective side view of the opposite side of the toe box protector shown in FIG. 3.

FIGS. 1 to 7 illustrate a pair of removable toe box protectors 2*a*, 2*b* for sneakers in accordance with an embodiment of the present invention. One of the toe box protectors 2*a* is configured for fitting to a right foot of a user and the other of the toe box protectors 2*b* is configured for fitting to a left foot of a user. Each toe box protector 2*a*, 2*b* can be removably inserted into a toe box of a sneaker (not shown) to prevent the upper surface of the toe box from creasing.

Each toe box protector 2*a*, 2*b* comprises a central portion 4 defining a front part 6 of the toe box protector 2*a*, 2*b* and, adjacent thereto, first and second opposite wing portions 8, 10 which extend rearwardly of the central portion 6 from respective opposite sides of the central portion 4. The first and second opposite wing portions 8, 10 define a rear part 12 of the toe box protector 2*a*, 2*b*.

The central portion 4 and the first and second opposite wing portions 8, 10 define an upper edge 14 of the toe box protector 2*a*, 2*b* and a lower edge 16 of the toe box protector 2*a*, 2*b*. The upper edge 14 of the toe box protector 2*a*, 2*b* is shaped and configured to be disposed adjacent to the instep, and along opposite sides of the instep, of a user's foot. The upper edge 14 of the toe box protector 2*a*, 2*b* forms a smoothly curved U-shape which is shaped and configured to fit adjacent to the instep, and along opposite sides of the instep, of the user's foot. The lower edge 16 of the toe box protector 2*a*, 2*b* is shaped and configured to be disposed around at least a portion of the toes, the inside edge of the user's foot, and the outside edge of the user's foot. In use, the lower edge 16 lies along a junction between the upper of the sneaker and the sole of the sneaker (not shown).

A cut-away part 18 is located on one side of the toe box protector 2*a*, 2*b* and extends across a region of the central portion 4 and a region of the first wing portion 8. The first wing portion 8 is shaped and configured to be disposed adjacent to an outer side of a user's foot. In the cut-away part 18, a portion of the lower edge 16 is in the form of a curved arc 20 which is raised relative to the lower edge 16 at opposite ends 22, 24 of the cut-away part 18 which are respectively positioned in the central portion 4 and the first wing portion 8. Accordingly, in use within the sneaker, the fifth toe of a user's foot extends through an opening 26 in the toe box protector 2*a*, 2*b* formed by the cut-away part 18.

A plurality of ventilation holes 82 extend through the central portion 4 to assist ventilation of the front part of the user's foot when covered by the toe box protector 2*a*, 2*b*.

Figure 5:
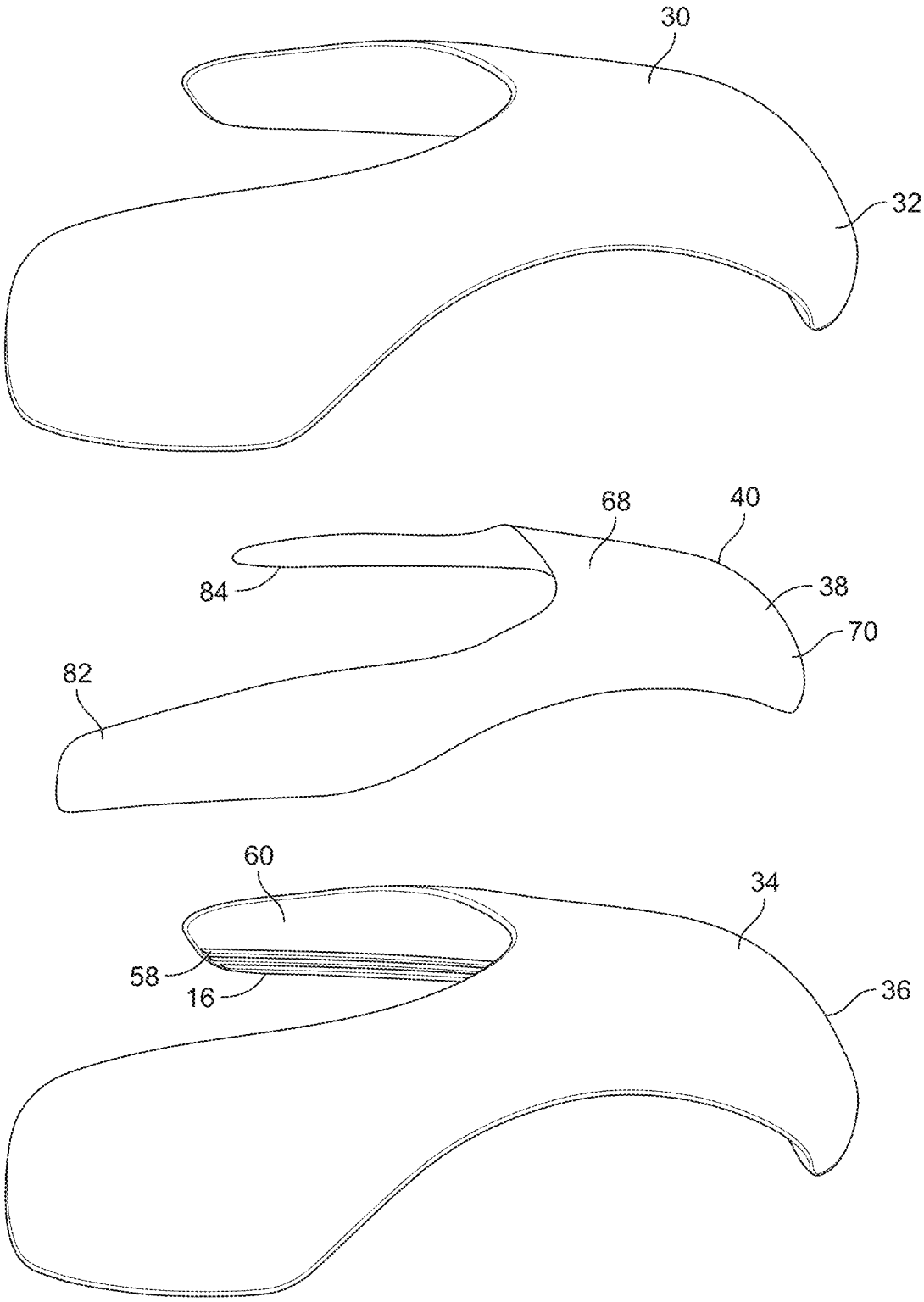
FIG. 5 is an exploded perspective side view of the one side of the toe box protector shown in FIG. 3.
Figure 6:
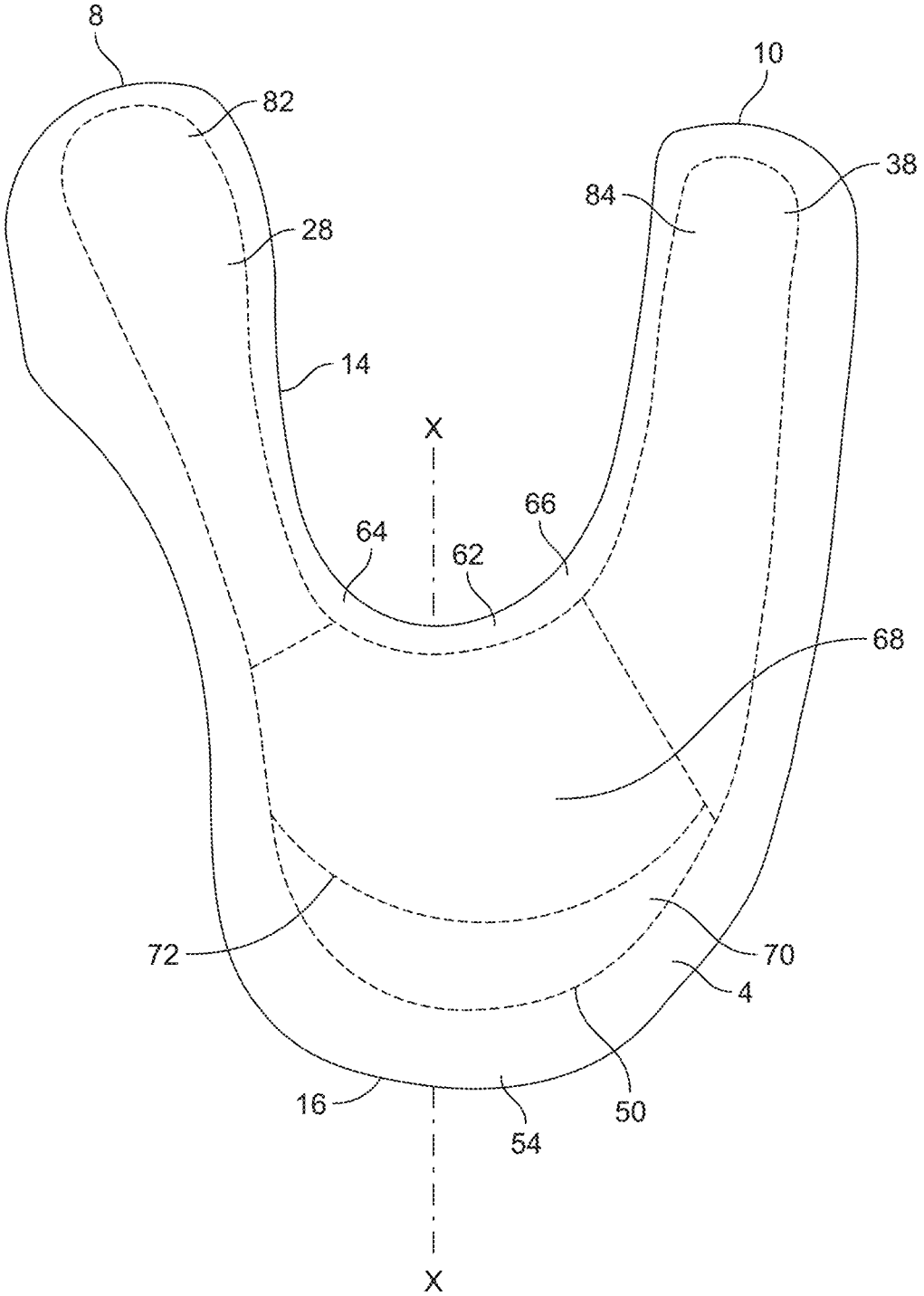
FIG. 6 is a plan view from above of the toe box protector shown in FIG. 3, and the Figure showing in phantom the shape and configuration of the core reinforcement between outer and inner layers of memory foam.
Figure 7:
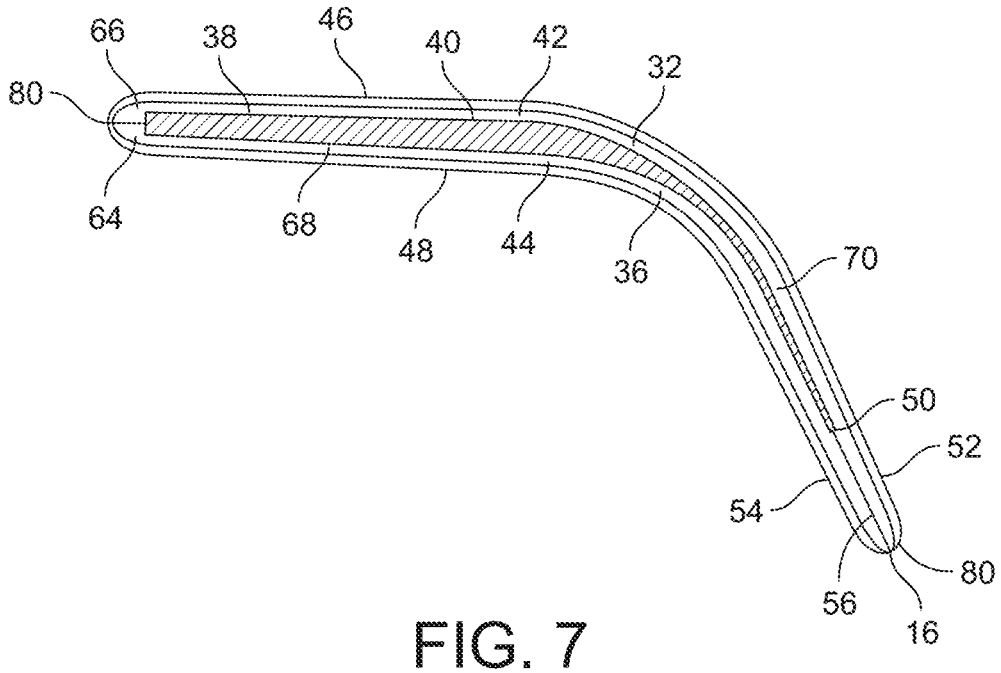
FIG. 7 is an exploded cross-section along line X-X through the toe box protector shown in FIG. 6.

Referring in particular to FIGS. 5 to 7, the central portion 4 and the first and second opposite wing portions 8, 10 comprise a sandwich structure 28. The sandwich structure 28 comprises an outer layer 30 comprising flexible cellular foam 32, an inner layer 34 comprising flexible cellular foam 36 and an intermediate core layer 38 comprising a reinforcement layer 40 of solid polymeric material. Typically, the outer, intermediate core, and inner layers of the sandwich structure 28 are adhered together by layers of adhesive (not shown) which adhere together the entire adjacent surfaces which are in contact with each other. Suitable adhesives for bonding together polymers materials are well known to those skilled in the art. As an alternative to adhesive bonding, thermal bonding may be employed to form the sandwich structure 28.

In the outer layer 30, the flexible cellular foam 32 comprises a first ply 42 of flexible cellular foam, preferably memory foam, and in the inner layer 34 the flexible cellular foam 36 comprises a second ply 44 of flexible cellular foam, preferably memory foam.

The first and second plies 42, 44 of flexible cellular foam, preferably memory foam, each have a thickness of from 1.5 to 4 mm, preferably from 2 to 3 mm, for example about 2 mm.

The outer layer 30 further comprises an outermost fabric ply 46 covering the flexible cellular foam 32 in the outer layer 30 and the inner layer 32 further comprises an innermost fabric ply 48 covering the flexible cellular foam 36 in the inner layer 32. The outermost fabric ply 46 and the innermost fabric ply 48 are composed of a synthetic wicking fabric, and typically the synthetic wicking fabric is composed of polyester fibres.

The intermediate core layer 38 is composed of a thermoplastic elastomer, and typically the thermoplastic elastomer comprises polyurethane. Typically, the intermediate core layer 38 is injection moulded to form a three-dimensionally shaped moulded article having the desired shape and configuration of the final toe box protector 2*a*, 2*b*.

The intermediate core layer 38 has a lower edge 50 which is spaced inwardly from the lower edge 16 of the toe box protector 2*a*, 2*b*. Accordingly, the lower edge 16 of the toe box protector 2*a*, 2*b* comprises a two layer structure 52 in the form of a peripheral flexible unreinforced lower band 54 in which the outer layer 30 is bonded directly to the inner layer 32, the two layers referring to the outer layer 30, which comprises the first ply 42 of flexible cellular foam and the outermost fabric ply 46, and the inner layer 32, which comprises the second ply 44 of flexible cellular foam and the innermost fabric ply 48.

In the peripheral flexible unreinforced lower band 54, the outer layer 30 is bonded to the inner layer 32 by a bonding area 56 which extends across a lateral width of the peripheral flexible unreinforced lower band 54.

The peripheral flexible unreinforced lower band 54 is configured to be manually cuttable to be reduced in lateral width by manually cutting peripherally along the bonding area 56. The bonding area 56 is configured to continue to bond together the outer layer 30 to the inner layer 32 and form a sealed lower edge after removal of part of the bonding area 54 by manual cutting.

The peripheral flexible unreinforced lower band 54 is provided with a plurality of mutually spaced, peripherally extending, marked cutting lines 58, illustrated in FIG. 5, which are spaced inwardly from, and substantially aligned with, the lower edge 16 of the toe box protector 2*a*, 2*b*. Typically, the cutting lines 58 are embossed into the lower band 54. Preferably, the cutting lines 58 are formed on an inner surface 60 of the toe box protector 2*a*, 2*b*.

The intermediate core layer 38 has an upper edge 62 which is spaced inwardly from the upper edge 14 of the toe box protector 2*a*, 2*b*. Accordingly, the upper edge 14 of the toe box protector 2*a*, 2*b* comprises a two layer structure 64, in the form of a peripheral flexible unreinforced upper band 66 in which the outer layer 30 is bonded directly to the inner layer 32, the two layers referring to the outer layer 30, which comprises the first ply 42 of flexible cellular foam and the outermost fabric ply 46, and the inner layer 32, which comprises the second ply 44 of flexible cellular foam and the innermost fabric ply 48.

In the two layer structures 52, 64, the outer and inner layers 30, 32 are directly bonded together around the entire peripheral edge of the toe box protector 2*a*, 2*b* by a pressure welded scam 80.

In the central portion 4, the intermediate core layer 38 has an upper rearward part 68 and a lower forward part 70. The upper rearward part 68 is substantially flat and substantially parallel to the lower edge 16. The lower forward part 70 is arcuate and extends downwardly from a curved front end 72 of the upper rearward part 68. The lower forward part 70 extends downwardly from the curved front end 72 of the upper rearward part 68 at an angle of from 30 to 60 degrees, for example about 45 degrees, to the upper rearward part 68. The upper rearward part 68 has a greater thickness, and a higher rigidity, than the lower forward part 70. The difference in thickness is illustrated in FIG. 7, although for clarity of illustration the thicknesses of the various layers are not shown to scale in FIG. 7. The upper rearward part 68 is shaped and configured to be disposed above the toes, and the lower forward part 70 is shaped and configured to be disposed in front of the toes of the user's foot.

The intermediate core layer 38 has first and second wing parts 82, 84 which respectively extend into the first and second opposite wing portions 8, 10.

In the first and second wing parts 82, 84, the intermediate core layer 38 has a smaller thickness, and a lower rigidity, than the upper rearward part 68 of the intermediate core layer 38 in the central portion 4.

In order to manufacture the toe box protector of the illustrated embodiment, the outer and inner layers, each comprising the ply of memory foam and the covering fabric ply, are cut to the desired two dimensional shape. The inner faces of the outer and inner layers are then coated with adhesive, and then these adhesive faces are applied to the opposite faces of the three-dimensionally shaped injection moulded intermediate core. The adhesive is allowed to cure. If necessary, the peripheral edge of the toe box protector may be trimmed and/or heat sealed. The outer and inner faces of the toe box protector may include embossing, to form the marked cutting lines and any other markings such as right/left; the embossing may be conducted before or after assembly of the inner and outer layers onto the intermediate core layer.

The preferred embodiment of the present invention can provide a removable toe box protector for sneakers which can be removably inserted into a toe box of a sneaker to prevent the upper surface of the toe box from creasing, and which exhibits increased comfort for the user, as compared to known removable toe box protectors, without a reduction in protection against creasing of the sneaker during use.

First, the inner layer which is adjacent to the foot of the user during use comprises a flexible cellular foam, preferably a memory foam, which increases the comfort for the user as compared to an injection moulded polymeric body.

Second, the intermediate core layer comprising a reinforcement layer of solid polymeric material provides reinforcement of the toe box protector, but is provided in a sandwich structure between outer and inner layers comprising the flexible cellular foam. Consequently, reinforcement can be provided to prevent or reduce creasing of the sneaker upper, while the fort is in contact with the inner layer comprising the flexible cellular foam.

Third, the reinforcement layer of solid polymeric material has upper and lower edges which are spaced inwardly, respectively, of the upper and lower edges of the toe box protector. Consequently, the upper edge of the toe box protector comprises a peripheral flexible unreinforced upper band, which is formed from the outer and inner layers comprising flexible cellular foam, and outer and inner fabric plies. Since the upper band is unreinforced, the upper band is highly flexible and therefore feels comfortable against instep, even after prolonged wearing of the sneakers. Correspondingly, the lower edge of the toe box protector comprises a peripheral flexible unreinforced lower band, which is also formed from the outer and inner layers comprising flexible cellular foam, and outer and inner fabric plies. Since the lower band is also unreinforced, the lower band is also highly flexible and therefore feels comfortable against the ends of the toes, even after prolonged wearing of the sneakers.

Fourth, the intermediate core layer, as well as being sandwiched between the outer and inner layers, is provided with regions of different thickness and rigidity, which can assist the achievement of the dual objectives of preventing creasing of the toe box and vamp of the sneaker and providing comfort for the user. By providing reinforcement using the relatively thick and relatively rigid upper rearward part of the intermediate core layer, which is disposed above the user's toes and is in contact with the inner surface of the upper of the toe box, and optionally part of the vamp, of the sneaker, creasing is prevented, and additionally by providing that the reinforcement includes the relatively thin and relatively flexible lower forward part of the intermediate core layer, which is disposed in front of the user's toes and is in contact with the inner surface of the front end of the toe box of the sneaker, comfort is not decreased by the reinforcement. Furthermore, the relatively thin and relatively flexible parts of the can extend into the wing portions of the toe box protector, to provide additional strength and reinforcement without compromising on comfort.

Overall, by using the intermediate core layer which is provided with regions of different thickness and rigidity, sandwiched between the outer and inner layers comprising flexible memory foam, an increased performance achieving both protection against creasing and comfort for the user can be achieved.

Fifth, the provision of self-wicking fabrics as the outermost and innermost layers of the toe box protector further increases the comfort for the user, particularly over extended wearing periods.

Various modifications to the toe box protector of the preferred embodiment will be apparat to the person skilled in the art, and such modifications may fall within the scope of the present invention as defined in the appended claims.

What is claimed is:

1. A toe box protector for sneakers which can be removably inserted into a toe box of a sneaker to prevent the upper surface of the toe box from creasing, the toe box protector comprising a central portion defining a front part of the toe box protector and, adjacent thereto, first and second opposite wing portions which extend rearwardly of the central portion from respective opposite sides of the central portion and define a rear part of the toe box protector, wherein the central portion and the first and second opposite wing portions define an upper edge of the toe box protector, which upper edge is shaped and configured to be disposed adjacent to the instep, and along opposite sides of the instep, of a user's foot, and a lower edge of the toe box protector, which lower edge is shaped and configured to be disposed around at least a portion of the toes, the inside edge of the user's foot, and the outside edge of the user's foot, wherein the central portion and the first and second opposite wing portions comprise a sandwich structure comprising an outer layer comprising flexible cellular foam, an inner layer comprising flexible cellular foam and an intermediate core layer comprising a reinforcement layer of solid polymeric material, wherein the intermediate core layer has a lower edge which is spaced inwardly from the lower edge of the toe box protector, wherein the lower edge of the toe box protector comprises a two layer structure in the form of a peripheral flexible unreinforced lower band in which the outer layer is bonded directly to the inner layer.

2. The toe box protector according to claim 1 further comprising a cut-away part which is located on one side of the toe box protector and extends across a region of the central portion and a region of first wing portion, the first wing portion being shaped and configured to be disposed adjacent to an outer side of a user's foot, wherein in the cut-away part a portion of the lower edge is in the form of a curved arc which is raised relative to the lower edge at opposite ends of the cut-away part which are respectively positioned in the central portion and the first wing portion, wherein in use within the sneaker, the fifth toe of a user's foot extends through an opening in the toe box protector formed by the cut-away part.

3. The toe box protector according to claim 1 wherein in the peripheral flexible unreinforced lower band the outer layer is bonded to the inner layer by a bonding area which extends across a lateral width of the peripheral flexible unreinforced lower band.

4. The toe box protector according to claim 3 wherein the peripheral flexible unreinforced lower band is configured to be manually cuttable to be reduced in lateral width by manually cutting peripherally along the bonding area, and the bonding area is configured to continue to bond together the outer layer to the inner layer and form a sealed lower edge after removal of part of the bonding area by manual cutting.

5. The toe box protector according to claim 4 wherein the peripheral flexible unreinforced lower band is provided with a plurality of mutually spaced, peripherally extending, marked cutting lines which are spaced inwardly from, and substantially aligned with, the lower edge of the toe box protector.

6. The toe box protector according to claim 1 wherein the intermediate core layer has an upper edge which is spaced inwardly from the upper edge of the toe box protector, wherein the upper edge of the toe box protector comprises a two layer structure, in the form of a peripheral flexible unreinforced upper band in which the outer layer is bonded directly to the inner layer.

7. The toe box protector according to claim 6 wherein the upper edge of the toe box protector forms a smoothly curved U-shape which is shaped and configured to fit adjacent to the instep, and along opposite sides of the instep, of the user's foot.

8. The toe box protector according to claim 1 wherein in the central portion the intermediate core layer has an upper rearward part and a lower forward part, wherein the upper rearward part is substantially flat and substantially parallel to the lower edge, and the lower forward part is arcuate and extends downwardly from a curved front end of the upper rearward part, wherein the upper rearward part has a greater thickness, and a higher rigidity, than the lower forward part.

9. The toe box protector according to claim 8 wherein the lower forward part extends downwardly from a curved front end of the upper rearward part at an angle of from 30 to 60 degrees to the upper rearward part.

10. The toe box protector according to claim 8 wherein the upper rearward part is shaped and configured to be disposed above the toes, and the lower forward part is shaped and configured to be disposed in front of the toes of the user's foot.

11. The toe box protector according to claim 8 wherein the intermediate core layer has first and second wing parts which respectively extend into the first and second opposite wing portions.

12. The toe box protector according to claim 11 wherein in the first and second wing parts the intermediate core layer has a smaller thickness, and a lower rigidity, than the upper rearward part of the intermediate core layer in the central portion.

13. The toe box protector according to claim 1 wherein in the outer layer the flexible cellular foam comprises a first ply of memory foam and in the inner layer the flexible cellular foam comprises a second ply of memory foam.

14. The toe box protector according to claim 13 wherein the first ply of memory foam and the second ply of memory foam each have a thickness of from 1.5 to 4 mm.

15. The toe box protector according to claim 1 wherein the outer layer further comprises an outermost fabric ply covering the flexible cellular foam in the outer layer and the inner layer further comprises an innermost fabric ply covering the flexible cellular foam in the inner layer.

16. The toe box protector according to claim 15 wherein the outermost fabric ply and the innermost fabric ply are composed of a synthetic wicking fabric, and optionally the synthetic wicking fabric is composed of polyester fibres.

17. The toe box protector according to claim 1 wherein the intermediate core layer is composed of a thermoplastic elastomer, and optionally the thermoplastic elastomer comprises polyurethane.

18. The toe box protector according to claim 1 wherein in the sandwich structure the outer and inner layers are directly bonded together around the entire peripheral edge of the toe box protector.

19. The toe box protector according to claim 18 wherein in the sandwich structure the outer and inner layers are directly bonded together around the entire peripheral edge of the toe box protector by a pressure welded seam.

20. A pair of toe box protectors according to claim 1, wherein one of the toe box protectors is configured for fitting to a right foot of a user and the other of the toe box protectors is configured for fitting to a left foot of a user.

* * * * *